US009604121B2

(12) United States Patent
Staton

(10) Patent No.: US 9,604,121 B2
(45) Date of Patent: Mar. 28, 2017

(54) HAND-WORN ARTICLE WITH AN ANTI-SLIP SURFACE

(71) Applicant: Saunjula Staton, Lorain, OH (US)

(72) Inventor: Saunjula Staton, Lorain, OH (US)

( * ) Notice: Subject to any disclaimer, the term of this patent is extended or adjusted under 35 U.S.C. 154(b) by 0 days.

(21) Appl. No.: 14/538,291

(22) Filed: Nov. 11, 2014

(65) Prior Publication Data

US 2015/0251076 A1 Sep. 10, 2015

Related U.S. Application Data

(60) Provisional application No. 61/902,410, filed on Nov. 11, 2013.

(51) Int. Cl.

| | |
|---|---|
| ***A63B 71/14*** | (2006.01) |
| ***A41D 19/015*** | (2006.01) |
| ***A41D 13/08*** | (2006.01) |
| *A63B 102/18* | (2015.01) |

(52) U.S. Cl.

CPC ..... *A63B 71/143* (2013.01); *A41D 13/087* (2013.01); *A41D 19/01558* (2013.01); *A63B 71/141* (2013.01); *A63B 71/146* (2013.01); *A63B 2102/18* (2015.10); *A63B 2102/182* (2015.10); *A63B 2209/10* (2013.01); *A63B 2243/0037* (2013.01)

(58) Field of Classification Search

CPC .... A63B 71/148; A63B 71/146; A41D 19/00; A41D 13/08

USPC ..... 2/161.1, 161.3, 161.4, 159, 16, 20

See application file for complete search history.

(56) References Cited

U.S. PATENT DOCUMENTS

| | | | | |
|---|---|---|---|---|
| 4,691,387 A * | 9/1987 | Lopez | ..... | A41D 19/01547 2/159 |
| 5,511,248 A * | 4/1996 | Widdemer | ..... | A63B 71/146 2/161.3 |
| 5,644,795 A * | 7/1997 | Landis | ..... | A63B 71/146 2/161.3 |
| 6,912,731 B2 * | 7/2005 | Cass | ..... | A41D 19/01564 2/160 |

* cited by examiner

*Primary Examiner* — Tejash Patel

(74) *Attorney, Agent, or Firm* — Pearne & Gordon LLP

(57) ABSTRACT

Provided is a finger sleeve for enhancing a grip on objects to be held by a hand. The finger sleeve includes a band of a flexible material forming a cylindrical passage through which a finger of the hand is to extend. A strap is coupled to the band, and is adjustable between an open state in which the finger sleeve is to be placed onto the finger and a closed state in which the strap interferes with removal of the finger sleeve from the finger. An anti-slip surface is provided to a palm-side of the band, and includes a grip enhancing material that improves a grip on the objects to be held in the hand while wearing the finger sleeve relative to the grip on the objects to be held in the hand without the finger sleeve.

8 Claims, 10 Drawing Sheets

HAND-WORN ARTICLE WITH AN ANTI-SLIP SURFACE

CROSS-REFERENCE TO RELATED APPLICATIONS

This application claims the benefit of U.S. Provisional Application No. 61/902,410, filed Nov. 11, 2014, which is incorporated in its entirety herein by reference.

BACKGROUND OF THE INVENTION

1. Field of the Invention

This application relates generally to sports equipment that enhances an athlete's grip on an object and, more specifically, to a hand-worn article that supports an anti-slip surface adjacent to at least one location of an athlete's hand to enhance an ability of the athlete to grip or otherwise control a ball or other equipment during an athletic event.

2. Description of Related Art

Athlete's such as baseball and softball players, for example, frequently grasp and throw a ball during the course of a game. The ball often rolls through grass before reaching the athletes, collecting moisture along the way. Rain is also common during the early portion of baseball and softball season, and collects on the ball and throwing hand of the athletes, thereby adding to the difficulty of gripping and throwing the ball, even if the ball has not made contact with the ground before reaching the athletes. Regardless of how moisture is collected at the interface between the ball and the athletes' hands, this moisture makes it difficult to grip and throw the ball accurately.

Athletes in other sports also commonly encounter situations where they lack the desired grip on a ball or other piece of equipment. For instance, basketball players sweat, often profusely, during a basketball game played within an indoor arena. Sweaty palms make it difficult to reliably dribble, pass, catch and shoot the basketball, and can significantly impede the ability of the players to play to realize their full potential.

Another situation where insufficient grip is encountered is when young children begin to enjoy a sport where they are required to grip a ball. Young children often have small hands compared to adult athletes. And although youth sports may use smaller diameter balls and smaller equipment in general, the size of youth athletic balls and equipment may still be larger than what the young athletes can accommodate with their small hands. If something out of the young athlete's control such as the size of their hands makes a sport difficult to play, young children may become quickly frustrated, and may be discouraged from pursuing the sport altogether.

Athletic gloves with a palm side that is coated with a tacky adhesive substance are known. Such gloves are commonly worn by athletes such as wide receivers in football, for example, to assist those wide receivers in catching passes from the quarterback. However, such gloves are often heavy, and may even include padding that detracts from the sensitivity of the wide receiver's hands that allow the wide receiver to "feel" the ball. Further, the tackiness covering the entirety of the conventional glove's palm side, while advantageous in football (i.e., maximizes the surface area with tack to grip the ball), could prove to be too tacky for gripping and throwing a baseball, thereby causing errant throws.

BRIEF SUMMARY OF THE INVENTION

According to one aspect, the subject application involves a finger sleeve for enhancing a grip on objects to be held by a hand. The finger sleeve includes a band of a flexible material forming a cylindrical passage through which a finger of the hand is to extend. The band forms a first aperture at a proximate end and a second aperture at a distal end, and comprises a length to permit a distal tip of the finger to extend through the second aperture. A strap is coupled to the band, and is adjustable between an open state in which the finger sleeve is to be placed onto the finger and a closed state in which the strap interferes with removal of the finger sleeve from the finger. An anti-slip surface is provided to a palm-side of the band, and includes a grip enhancing material that improves a grip on the objects to be held in the hand while wearing the finger sleeve relative to the grip on the objects to be held in the hand without the finger sleeve.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

BRIEF DESCRIPTION OF SEVERAL VIEWS OF THE DRAWING

The invention may take physical form in certain parts and arrangement of parts, embodiments of which will be described in detail in this specification and illustrated in the accompanying drawings which form a part hereof and wherein.

DETAILED DESCRIPTION OF THE INVENTION

Figure 1:
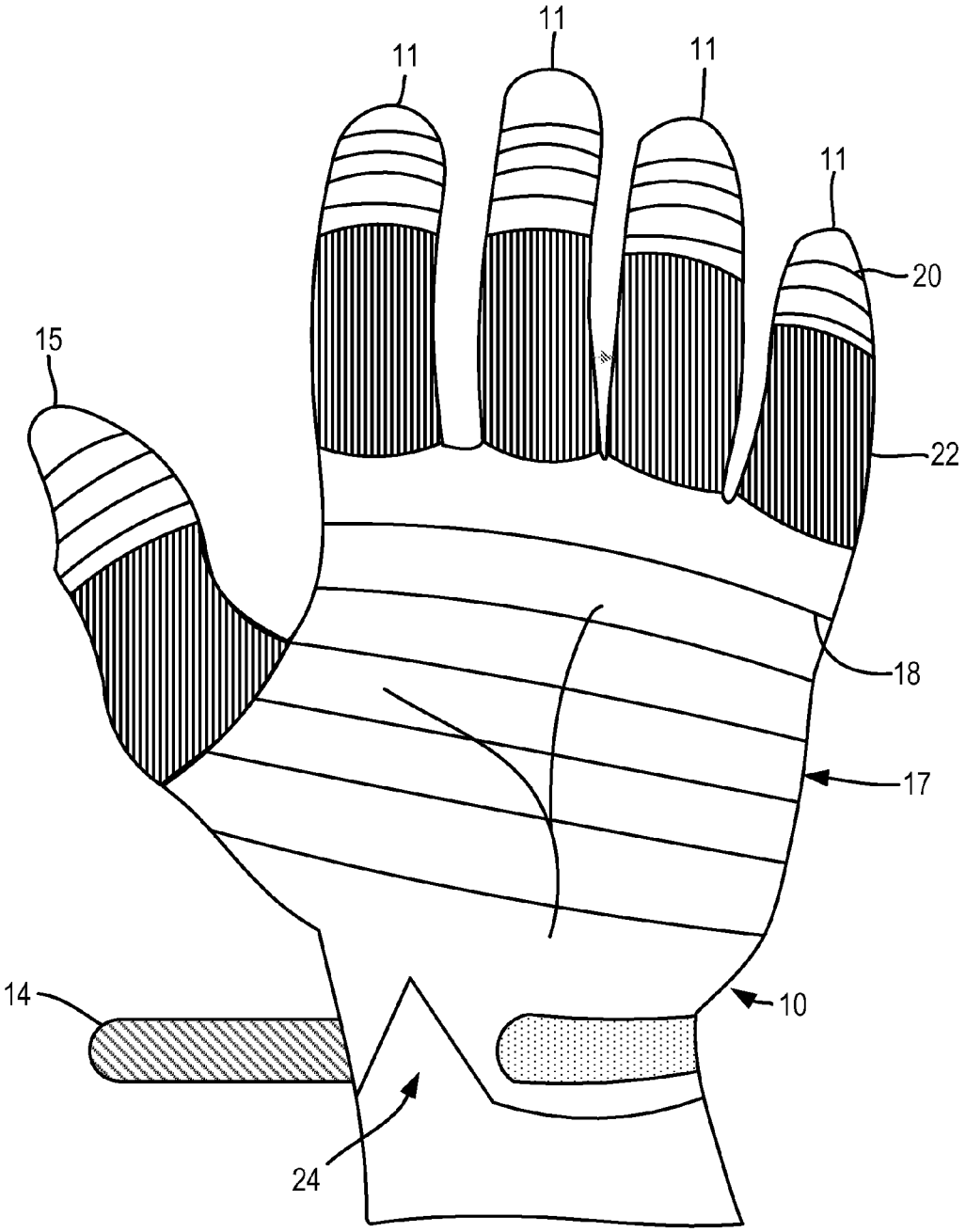
FIG. 1 is a palm-side view of a hand-worn article including a plurality of finger sleeves.

Certain terminology is used herein for convenience only and is not to be taken as a limitation on the present invention. Relative language used herein is best understood with reference to the drawings, in which like numerals are used to identify like or similar items. Further, in the drawings, certain features may be shown in somewhat schematic form.

It is also to be noted that the phrase "at least one of", if used herein, followed by a plurality of members herein means one of the members, or a combination of more than one of the members. For example, the phrase "at least one of a first widget and a second widget" means in the present application: the first widget, the second widget, or the first widget and the second widget. Likewise, "at least one of a first widget, a second widget and a third widget" means in the present application: the first widget, the second widget, the third widget, the first widget and the second widget, the first widget and the third widget, the second widget and the third widget, or the first widget and the second widget and the third widget.

FIG. 1 shows a palm side of a hand-worn article 10 according to an illustrative embodiment comprising an anti-slip surface 22 provided to a portion of each finger 11 and the thumb 15 of a hand 17. The hand-worn article 10 in FIG. 1 has a physical appearance that resembles a glove, but the material at locations other than the anti-slip surfaces 22 on the palm side can be a mesh 18, that leaves portions of the hand 17 exposed while being worn. For the embodiment shown in FIG. 1, the mesh 18 comprises laterally-extending strips of an elastic, or at least substantially-elastic material such as Lycra®, or any other suitable elastane, for example.

The anti-slip surfaces 22 are located at regions of the fingers 11 and thumb 15 on the palm side of the hand-worn article 10 that contact a baseball/softball or other ball used in a sport for which the hand-worn article 10 is designed. As shown in FIG. 1, the anti-slip surfaces 22 extend along a portion of each finger 11 from about a joint connecting the fingers 11 to the palm of the hand 17, to about a final knuckle joint of each finger 11. A tip of each finger 11 can optionally be left exposed, or at least partially exposed for the illustrative embodiment of FIG. 1 except as concealed by the mesh 18. Similarly, the anti-slip surface 22 provided to the thumb extends from about a joint between the thumb 15 and the palm of the hand 17 to about the knuckle joint of the thumb 15. Leaving portions of the hand 17, fingers 11 and/or thumb 15 exposed as shown in FIG. 1 allows the athlete wearing the hand-worn article 10 to retain a sensitivity in the exposed portions of the hand 17, fingers 11 and thumb 15 that is approximately equal to that of a bare hand, allowing the athlete to "feel" the ball being thrown.

The anti-slip surfaces 22 can be formed from any material that enhances the grip of a ball used in the sport for which the hand-worn article 10 is designed over the grip achievable with the bare hand. Thus, the material included as part of the anti-slip surfaces 22 can vary depending on the ball to be gripped, and provides enhanced grip on a ball or other sporting good in the presence of moisture. With that said, however, examples of the anti-slip surface 22 include, but are not limited to, a grit material adhered to the finger portions of the hand-worn article 10, wherein the grit material can optionally be coated with a protective finish; a tacky material; a rubberized material; a cloth material that resists becoming slippery when wet; and the like.

One or more of the anti-slip surfaces 22 can optionally protrude outwardly, away from the palm side of the fingers 11 and thumb 15, relative to surrounding areas of the hand-worn article 10. Elevating the anti-slip surfaces 22 in this manner promotes contact between the ball and the anti-slip surfaces 22 to enhance the athlete's ability to grip or otherwise control the ball.

Although embodiments of the hand-worn article 10 include a substantially-elastic fit that conforms to the hand 17, a wrist strap 14 can optionally be provided to the hand-worn article 10. The wrist strap 14 can optionally include cooperating segments of hook-and-loop fasteners such as that offered under the brand name Velcro, cooperating snap portions, tie strings, or any other suitable configuration that function to interfere with removal of the hand-worn article 10, for example.

Figure 2:
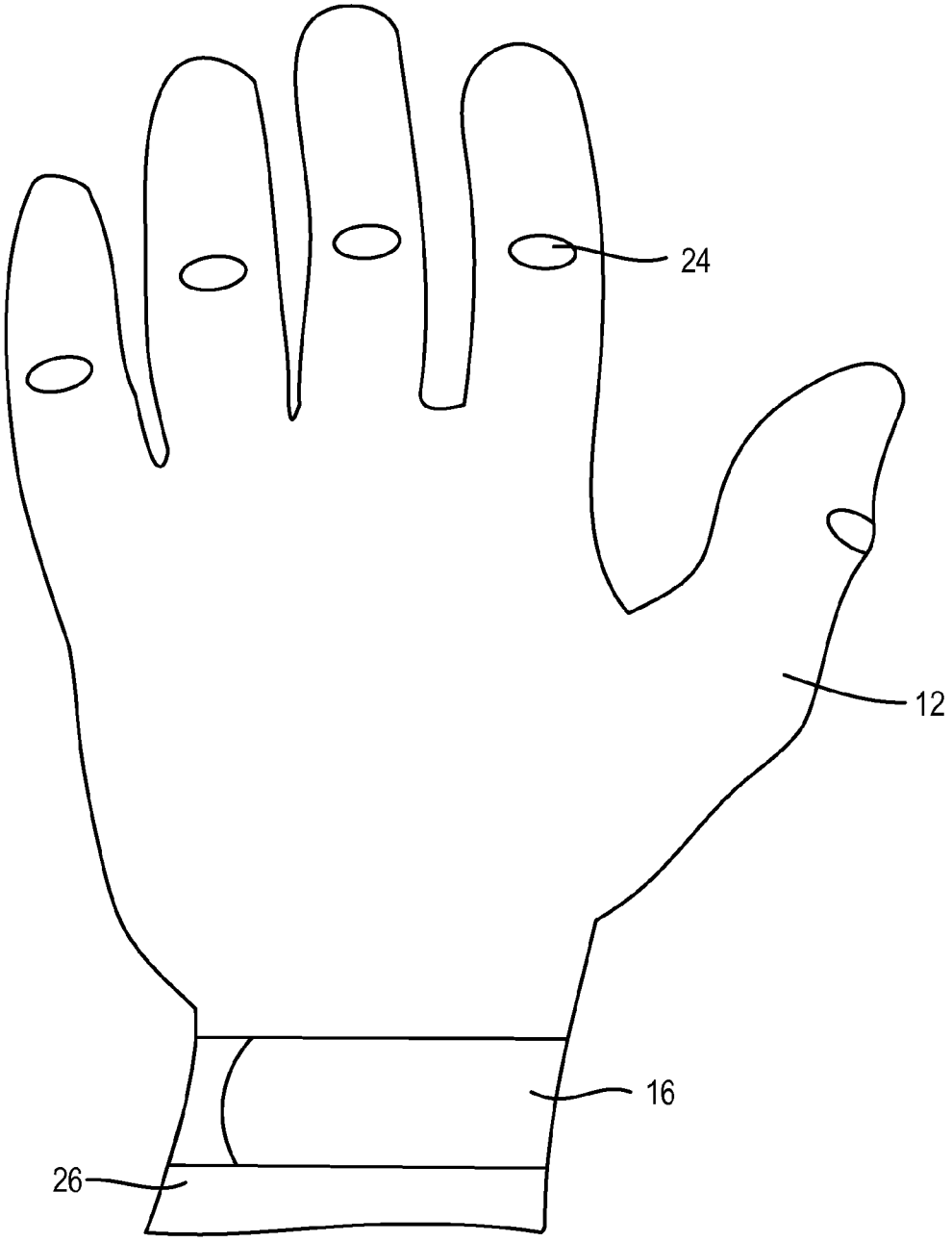
FIG. 2 shows a back side of the hand-worn article shown in FIG. 1, comprising a knuckle aperture provided to a portion of each finger sleeve.

FIG. 2 shows an illustrative embodiment of a back side 12 of the hand-worn article 10 shown in FIG. 1. The back side 12 of the hand 17, since it does not come into contact with the ball being thrown, can be formed of any desired material, which can optionally be a mesh 18. For example, the back side 12 of the hand-worn article 10 can be formed from a substantially-continuous, elastic material that establishes a fit that conforms to the athlete's hand 17 while being worn. A knuckle aperture 24 can be formed at locations that are to align with knuckles provided to the fingers 11 and thumb 15 to minimize interference with the ability of the athlete to bend the fingers 11 and thumb 15 while wearing the hand-worn article 10.

Figure 3:
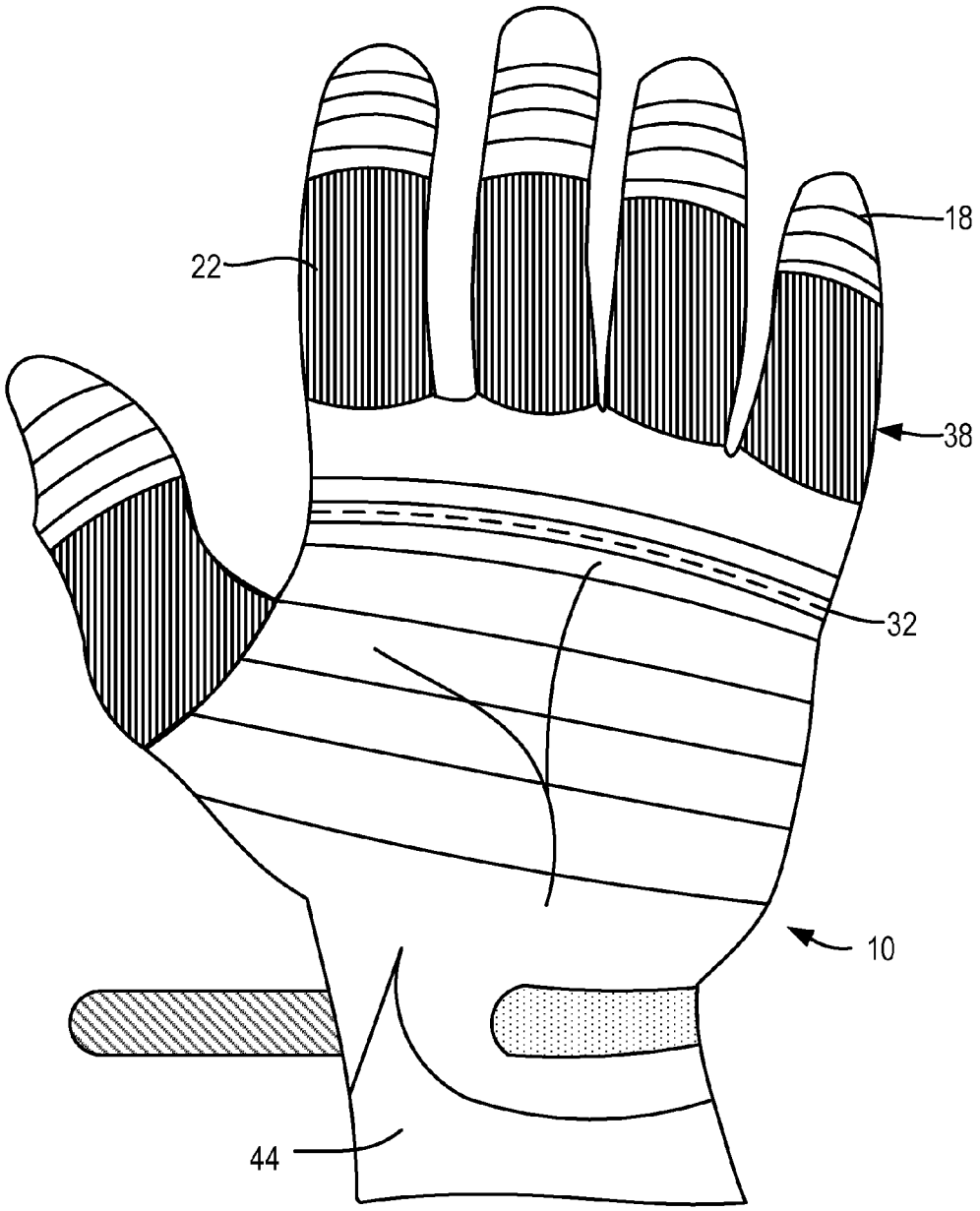
FIG. 3 shows a palm side of a hand-worn article according to an illustrative embodiment comprising an anti-slip surface provided to a portion of each finger, wherein each finger is removably coupled to the hand-worn article by operation of a zipper device or other releasable fastener that can repeatedly couple and release the finger sleeves.

FIG. 3 shows another illustrative embodiment of the hand-worn article 10, which also has a physical appearance that resembles a glove. Like the embodiment shown in FIG. 1, the current embodiment includes a mesh 18 covering the palm and tip of each finger 11 and thumb 15. The current embodiment also includes a removable fastener 32 that removably couples finger portions 38 of the hand-worn article 10 to be detached and re-attached to the portion of the hand-worn article 10 provided to the palm of the hand 17. The removable fastener 32 can include a zipper track that can be connected and disconnected by hand, cooperating segments of a hook-and-loop fastener, and the like.

Figure 4:
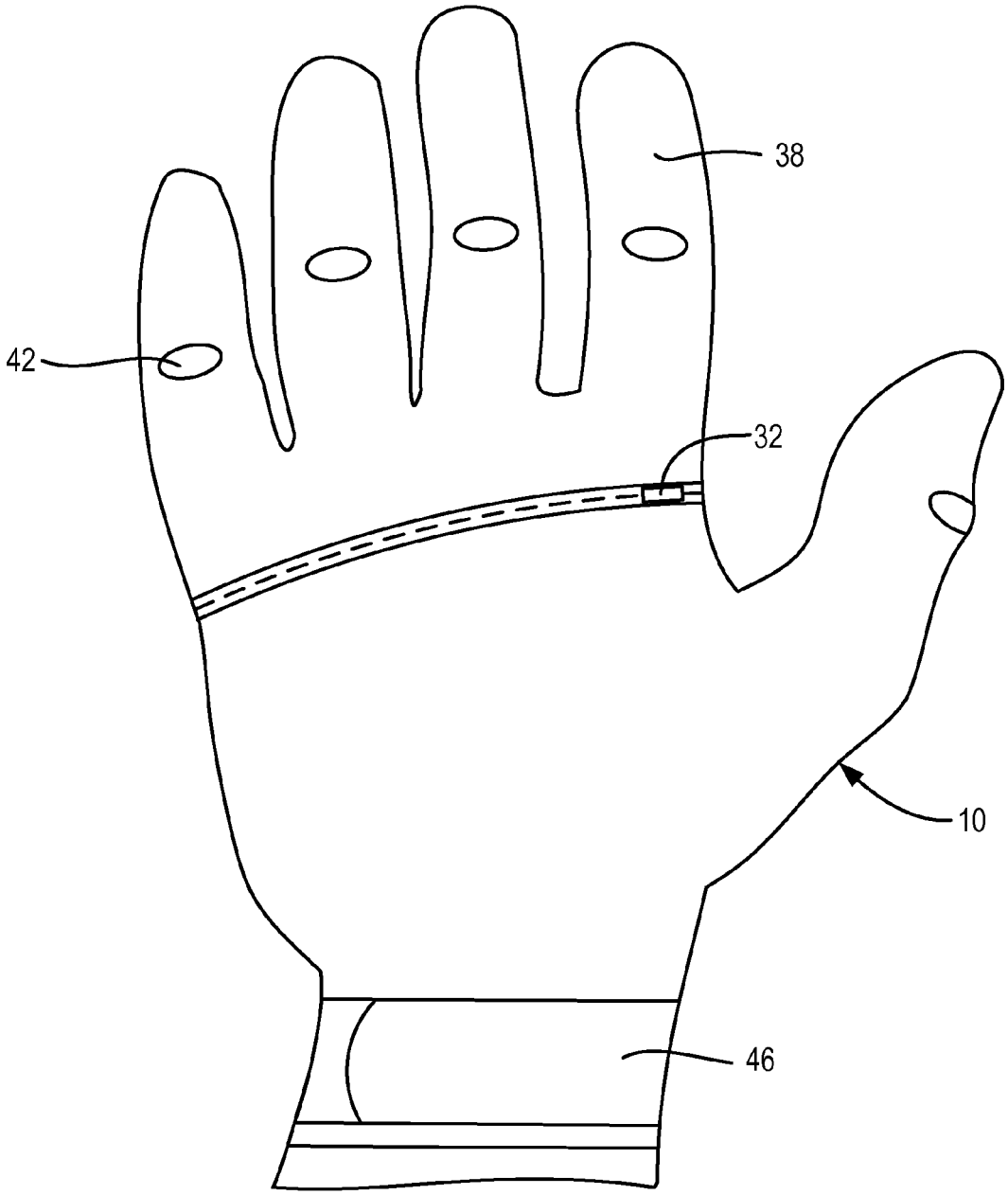
FIG. 4 shows a back side of the hand-worn article shown in FIG. 3, comprising an anti-slip surface provided to a portion of each finger, wherein each finger is removably coupled to the hand-worn article by operation of a zipper device.

FIG. 4 shows a back side of the hand-worn article 10 shown in FIG. 3. As shown in FIG. 4, the removable fastener 32 can wrap entirely around the hand 17, allowing complete separation of the finger portions 38 of the hand-worn article 10 from the remainder of the hand-worn article 10, which can remain in place when the finger portions 38 are removed.

Figure 5:
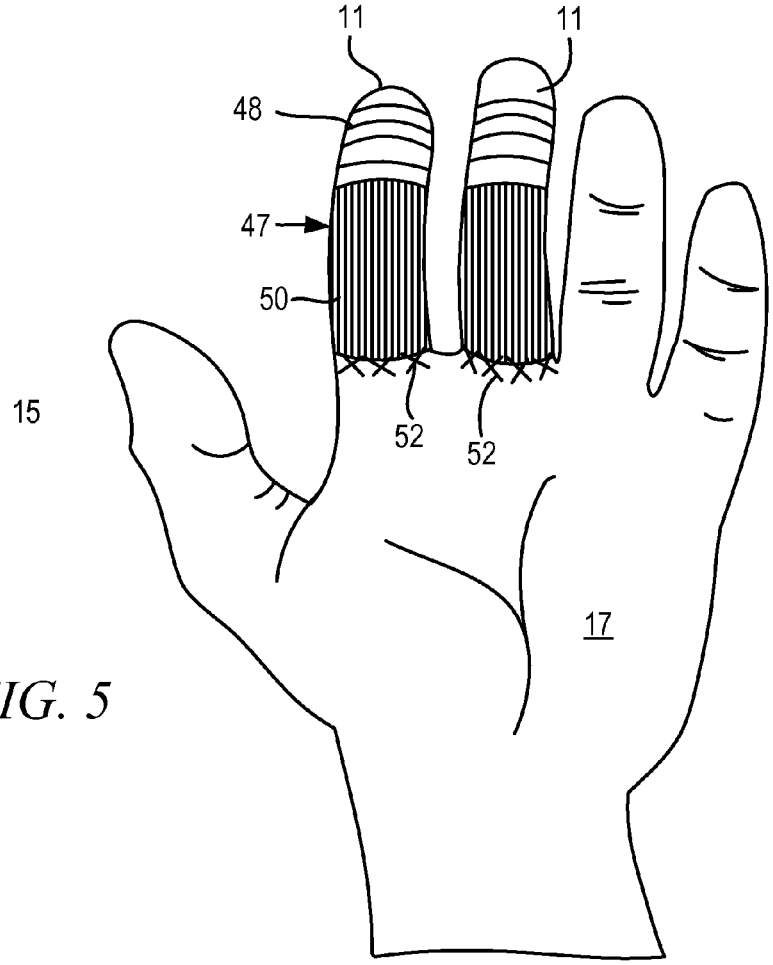
FIG. 5 shows a palm side of an illustrative embodiment of a finger sleeve worn on each of an index finger and a middle finger of a hand, each finger sleeve comprising an anti-slip surface that covers a portion of the finger that is to contact a ball being thrown.
Figure 6:
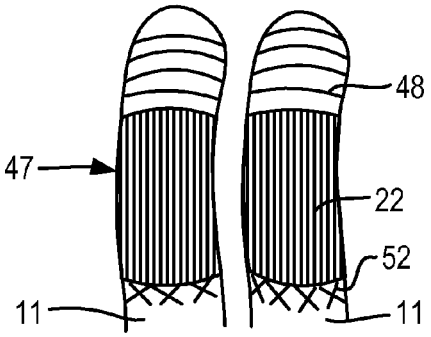
FIG. 6 shows an isolated view of the palm side of the fingers wearing the finger sleeves shown in FIG. 5.

FIGS. 5 and 6 show a palm side of another illustrative embodiment of a hand-worn article 10. The current embodiment includes a finger sleeve 47 that is to be worn on one, or a plurality of fingers 11, and optionally the thumb 15. As shown in FIGS. 5 and 6, a finger sleeve 47 is worn on each of the index finger and middle finger of the hand 17. Like the finger portions 38 provided to the glove-like embodiments described above, each finger sleeve 47 includes the anti-slip surface 22 that covers a portion of the finger 11 that is to contact a ball being thrown. Each finger sleeve 47 can also include an elastic, or at least substantially-elastic material 48 at a distal end adjacent a fingertip. The material 48 can be any suitable material such as the mesh 18 material to extend around the finger 11, and can optionally terminate short of the finger tip, leaving the tip of the finger 11 exposed. Each finger sleeve 47 can also optionally include a band of an elastic, or at least substantially-elastic material 52 to form a fitted bottom portion of the finger sleeves 47 that is approximately equal in diameter to the diameter of the finger 11 that is to wear the finger sleeve 47.

Figure 7:
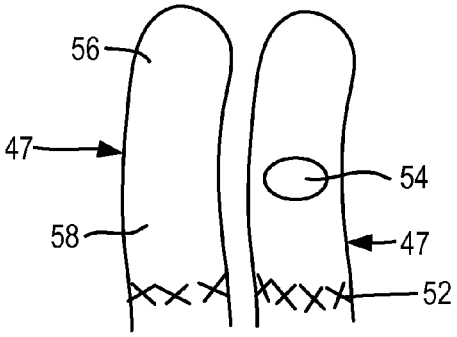
FIG. 7 shows a back side of the fingers wearing the finger sleeves shown in the isolated view of FIG. 6.

As shown in FIG. 7, the back side of the finger sleeves 47 can be formed from an elastic, or at least substantially-elastic material 58, which can optionally be water resistant. Further, each finger sleeve 47 can optionally include a knuckle opening 54 for venting and flexibility purposes, or can be formed without a knuckle opening, as indicated at location 56. According to alternate embodiments, the finger sleeves 47 can optionally be formed from a strip of a flexible material provided with an adhesive coating on one side to adhere the strip of flexible material to the finger 11 in a manner analogous to a BandAid® brand adhesive bandage. The anti-slip surface 22 can optionally be provided to the strip of flexible material such that the anti-slip surface 22 is positioned adjacent to the palm side of the fingers 11 when the strip of flexible material is wrapped at least partially around a finger 11 and held in place by the adhesive coating.

According to yet other embodiments, the finger sleeves 47 do not form "sleeves" per se. Instead, such embodiments can include a liquefied anti-slip material that can be applied to a portion of the fingers 11 facing the palm side of the hand and allowed to dry to form the anti-slip surface 22 directly on the fingers 11 themselves. Once dry, the anti-slip surface 22 can include a gritty texture, rubberized texture, etc . . . that enhances the grip of a ball in the presence of moisture over the grip that can be accomplished with a bare hand. Such an anti-slip surface 22 can optionally be non-water soluble, requiring the use of a solvent in which the anti-slip surface 22 is soluble to remove the anti-slip surface 22 from the fingers 11 when the anti-slip surface 22 is no longer needed.

Figure 8:
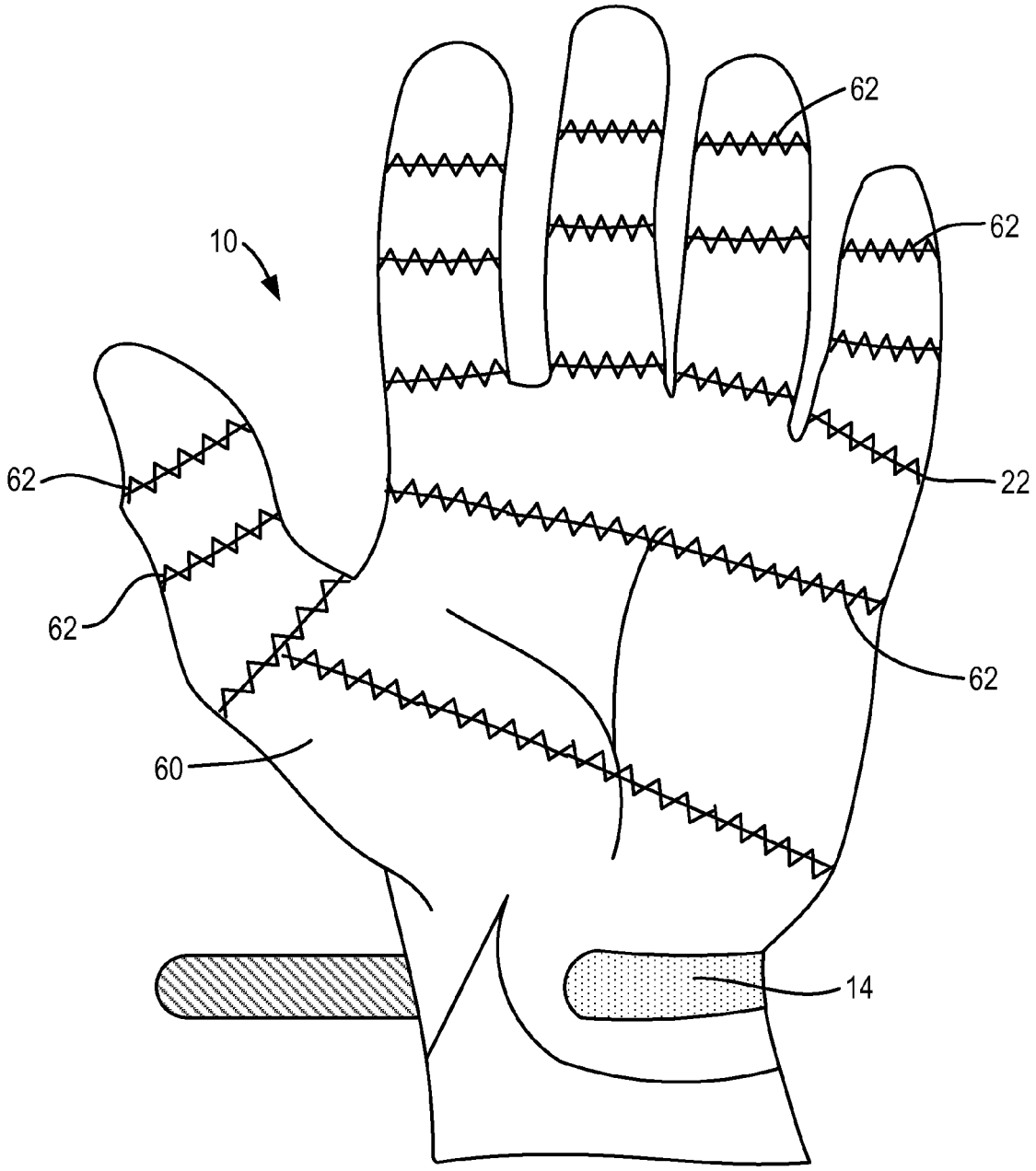
FIG. 8 shows a palm side of a hand-worn article according to an illustrative embodiment comprising a plurality of regions of anti-slip surface that protrude outwardly from a surface of the hand-worn article.
Figure 9:
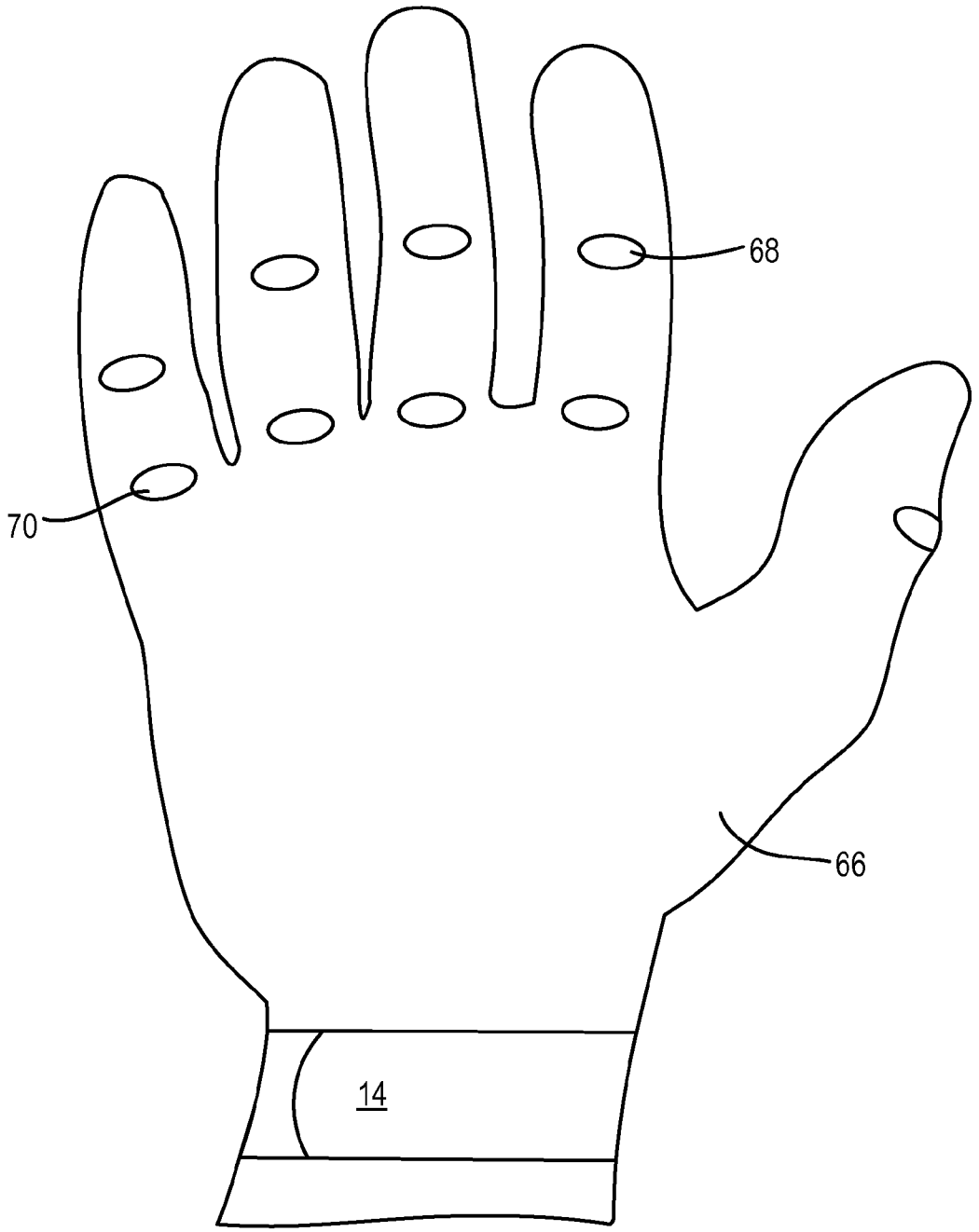
FIG. 9 shows a back side of the hand-worn article shown in FIG. 8, comprising a knuckle aperture provided to a portion of each finger sleeve.

Another illustrative embodiment of the hand-worn article 10 is shown in FIGS. 8 and 9. As shown, the hand-worn article 10 includes a substantially-flat, and optionally water-resistant material 60 forming a glove-like fit on the hand 17. A plurality of elevated ridges 62 extend over portions of the material 60. One or more, a plurality, or optionally each of the ridges 62 can include the anti-slip surface 22 to provide the wearer of the hand-worn article 10 with enhanced grip on a ball or other sporting equipment. The ridges 62 are said to be elevated in that they protrude outwardly, away from the hand 17 when the hand-worn article 10 is worn by the athlete. And similar to the previous glove-like embodiments, a wrist strap 14 can be provided to interfere with removal of the hand-worn article 10 when fastened.

Also similar to the glove-like embodiments described above, the back side of the hand-worn article 10, shown in FIG. 9, can be formed from a water-resistant material 66, and can optionally include knuckle openings 68, which can optionally be made adjustable as shown at 70.

Figure 10:
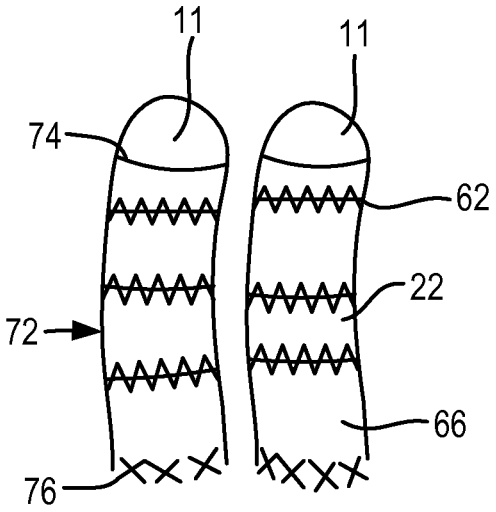
FIG. 10 shows a palm side of an illustrative embodiment of a finger sleeve worn on each finger of a hand, each finger sleeve comprising a plurality of regions of anti-slip surface that contact a ball being thrown by the hand.
Figure 11:
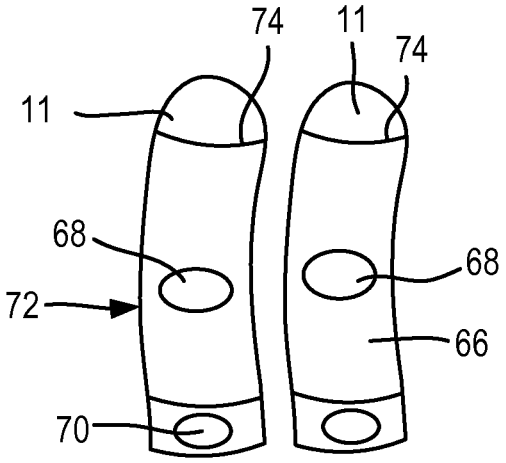
FIG. 11 shows a back side of the finger sleeves being worn on each of the fingers of the hand shown in FIG. 10, the finger sleeves comprising knuckle openings and fingertip openings.

FIGS. 10 and 11 show illustrative embodiments of the hand-worn article 10 as finger sleeves 72 instead of the glove-like embodiments. Again the finger sleeves 72 cover a portion of the fingers 11, and can optionally include a finger opening 74 adjacent to a tip of each finger 11 to expose each fingertip. The finger sleeves 66 can be formed from an elastic, or at least substantially-elastic (optionally water resistant) material 66 to conform to the shape of the fingers 11, and include a band of an elastic, or at least substantially-elastic material 76 to form a fitted bottom portion of the finger sleeves 72 that is approximately equal in diameter to the diameter of the finger 11 that is to wear the finger sleeve 72. For the current embodiments, and optionally other embodiments, the anti-slip material 22 provided to each finger sleeve 72 can optionally extend a substantial portion, or optionally entirely around the circumference of each finger sleeve 72. And as shown in FIG. 11, each finger sleeve 72 can optionally include one or more knuckle openings 68, one or more of which can optionally be made adjustable 70.

Figure 12:
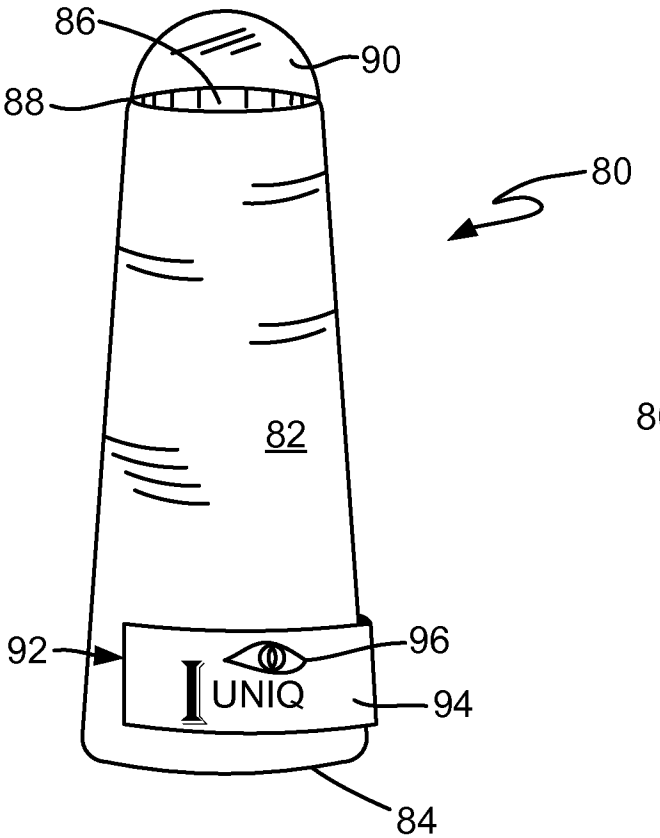
FIG. 12 shows a top, dorsal view (a knuckle side) of a finger sleeve in accordance with an illustrative embodiment of the hand-worn article, including an extension that extends longitudinally beyond an aperture where a distal tip of a finger exits the finger sleeve.

FIG. 12 shows a top, dorsal view (i.e., a view of the knuckle side) of a finger sleeve 80 in accordance with another illustrative embodiment of the hand-worn article. The present embodiment of the finger sleeve 80 can optionally include one or more of the features of the fingers and other hand-worn articles 10 described above. As shown, the finger sleeve 80 includes a band 82 of a stretchable, flexible material sewn or otherwise formed into a shape defining a cylindrical interior passage through which a finger is to extend. The material forming the band 82 extends entirely about the wearer's finger while the finger sleeve 80 is being worn. While being worn, a proximate end 84 of the sleeve 80 encircles, and is terminated at a region near the base of the finger, where the finger meets the palm of the hand. Thus, proximate end 84 of the band 82, and sleeve 80, is terminated short of the palm of the hand, thereby allowing the full palm region of the hand to be exposed while the sleeve 80 is being worn. The size and shape of the band 82 can optionally be specifically tailored to fit appropriately onto different fingers for use in athletic events, allowing the distal tip of the finger (e.g., a region of the finger beyond the final joint) with the fingernail to protrude out of an aperture 86 formed at the distal end 88 of the finger sleeve 80.

Figure 15:
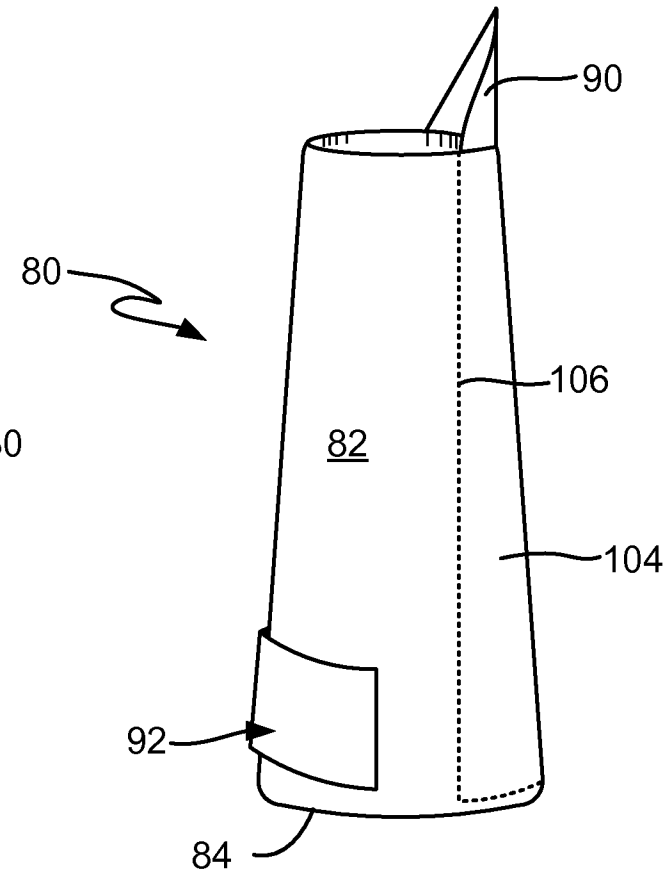
FIG. 15 shows a right side view of the finger sleeve appearing in FIG. 12.

At the distal end 88, the finger sleeve 80 also includes an extension 90 that extends longitudinally beyond the aperture 86 where the distal tip of the finger exits the finger sleeve 80. The embodiment of the extension 90 shown in FIGS. 12-15 is semi-circular in shape, and is arcuate about a longitudinal axis of the sleeve 80 as shown in FIG. 15 to wrap at least partially about the finger on which the sleeve 80 is being worn. However, any suitable shape to separate the palm-side of the finger tip from an object being held in the wearer's hand will suffice.

Figure 13:
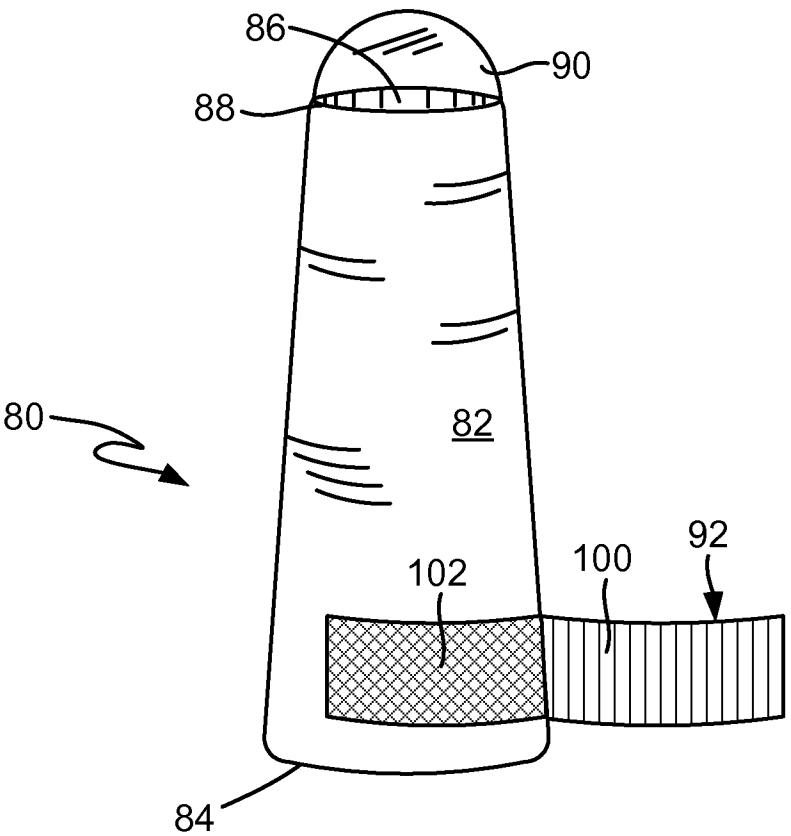
FIG. 13 shows the finger sleeve appearing in FIG. 12, with a strap secured in place by hook-and-loop fasteners in FIG. 12 in the open position to allow insertion and removal of a finger.

Also shown in FIGS. 12 and 13 is a strap 92 that can be adjusted between open (FIG. 13) and closed (FIG. 12) configurations to allow the sleeve 80 to be put on a finger and to hold the sleeve 80 in place on the finger after being put on, respectively. The outwardly-exposed surface 94 of the strap 92 can include a design element 96 such as a logo of a sports team, a school or other academic institution, a proprietor responsible for the sale and/or manufacture of the sleeve 80, and/or any other entity. Such a logo can include at least one of an alpha and/or numeric character, a symbol, a photograph, a drawing, and the like. An inward-facing surface of the strap 92, which faces the finger while the strap 92 is in the closed orientation, is provided with a portion 100 of a releasable fastener system that allows for the repeated closing and subsequent opening of the strap 92 without damaging the strap 92. Another portion 102 of the releasable fastening system, which cooperates with the first portion 100, can be provided to the exterior of the band 82 of the sleeve 80. For example, the portions 100, 102 of the releasable fastening system can be compatible segments of a hook-and-loop fastener, opposite portions of a snap assembly, and the like. When closed, the strap 92 imparts a compressive force on the finger, thereby interfering with removal of the sleeve 80 there from.

Figure 14:
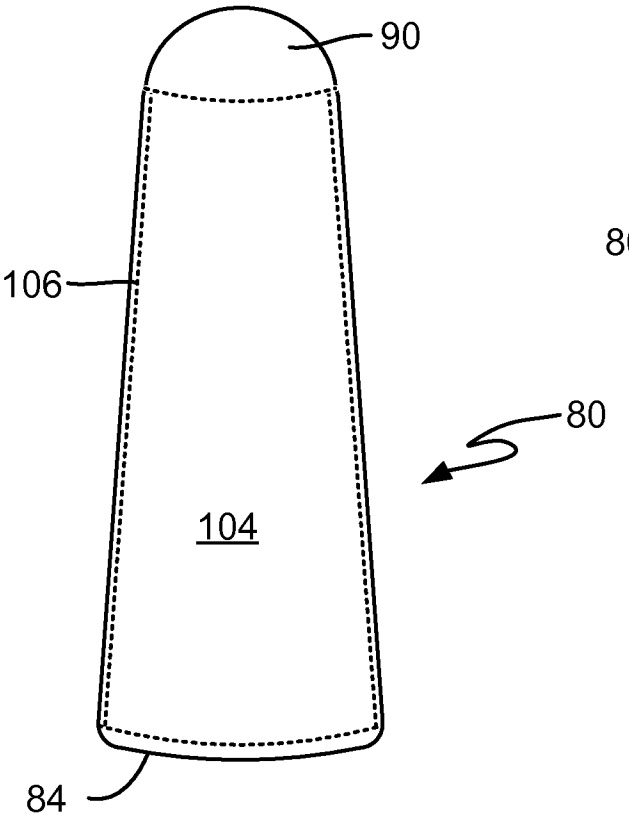
FIG. 14 shows a palm-side view of a grip-enhancing surface that is to be disposed between an object being held in the hand of a person wearing the finger sleeve and the person's finger.

FIG. 14 shows a palm-side view of an anti-slip surface 104 that is to be disposed between an object (e.g., a ball) being held in the hand of a person wearing the finger sleeve 80 and that person's finger. Similar to the embodiments described above, the anti-slip surface 104 can include a gritty material (e.g., small particulates adhered to the palm side of the sleeve 80), can include a rubberized surface or include small circular dots of the rubberized material distributed over a portion of the band 82, or can be formed from a durable material such as leather, to establish a gripping surface. This material can be adhered to the band 82, integrally formed as part of a monolithic structure with the band 82, can be sewn in place with stitching 106 along the length of the band 82 as an additional layer covering a portion of the band 82 separating the finger from the object being held, as shown in FIG. 15, or otherwise provided to the sleeve 80. The anti-slip surface 10 can optionally be provided only to the palm-facing half (e.g., limited to no more than a region spanning approximately 180° about the outer periphery of the band 82 between the lateral sides of the band 82) of the finger sleeve 80, and can optionally not extend entirely about the finger while the finger sleeve is being worn And regardless of the type of material forming the anti-slip surface 104, this material can extend beyond the distal end 88 of the band 82 to form the extension 90 and extend along a greater extent of the finger than the band 82. In other words, the extension 90 extends along a distal portion of the finger that is not also encompassed by the band 82. Thus, the extension 90 provides a greater portion of the finger than that protected by the band 82 with the benefit of the anti-slip surface 104.

Illustrative embodiments have been described, hereinabove. It will be apparent to those skilled in the art that the above devices and methods may incorporate changes and modifications without departing from the general scope of this invention. It is intended to include all such modifications and alterations within the scope of the present invention. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A finger sleeve for enhancing a grip on objects to be held by a hand, the finger sleeve comprising:

a band of a flexible material formed to define a cylindrical passage through which a finger of the hand is to extend, wherein the band forms a first aperture at a proximate end and a second aperture at a distal end, and comprises a length to permit a distal tip of the finger to extend through the second aperture;

a strap coupled to the band, wherein the strap is adjustable between an open state in which the finger sleeve is to be placed onto the finger and a closed state in which the strap interferes with removal of the finger sleeve from the finger;

an anti-slip surface provided to a palm-side of the band, the anti-slip surface comprising a grip enhancing material that improves a grip on the objects to be held in the hand wearing the finger sleeve relative to a grip on the objects to be held in the hand without the finger sleeve; and an extension of the anti-slip surface that protrudes beyond the distal end of the band to be disposed adjacent to the distal tip of the finger that is not also encompassed by the band.

2. The finger sleeve of claim 1 wherein a material forming the anti-slip surface is different than a material forming the band.

3. The finger sleeve of claim 1 further comprising a decorative element adorning an outwardly-exposed surface of the strap.

4. The finger sleeve of claim 1 further comprising a releasable fastening system that couples the strap in the closed state to the band to maintain the strap in the closed state.

5. The finger sleeve of claim 1, wherein the flexible material of the band extends entirely about a circumference of the finger.

6. The finger sleeve of claim 5, wherein the grip-enhancing material is coupled to an exterior of the band along, a palm side of the band.

7. The finger sleeve of claim 6, wherein the grip-enhancing surface does not extend entirely about the finger while the finger sleeve is being worn.

8. A finger sleeve for enhancing a grip on objects to be held by a hand, the finger sleeve comprising:

a band of a flexible material formed to define a cylindrical passage through which a finger of the hand is to extend, wherein the band forms a first aperture at a proximate end and a second aperture at a distal end, and comprises a length to permit a distal tip of the finger to extend through the second aperture;

a strap coupled to the band, wherein the strap is adjustable between an open state in which the finger sleeve is to be placed onto the finger and a closed state in which the strap interferes with removal of the finger sleeve from the finger; and an anti-slip surface provided to a palm-side of the band, the anti-slip surface comprising a grip enhancing material that improves a grip on the objects to be held in the hand wearing the finger sleeve relative to a grip on the objects to be held in the hand without the finger sleeve, wherein the flexible material of the band extends entirely about a circumference of the finger.

* * * * *